US009322144B2

(12) United States Patent
Sinclair

(10) Patent No.: US 9,322,144 B2
(45) Date of Patent: Apr. 26, 2016

(54) MANHOLE COVER ASSEMBLY WITH CAMS

(75) Inventor: David Brent Sinclair, St. Lazare (CA)

(73) Assignee: IM2 MERCHANDISING AND MANUFACTURING INC., Saint-Lazare, QC (CA)

( * ) Notice: Subject to any disclaimer, the term of this patent is extended or adjusted under 35 U.S.C. 154(b) by 0 days.

(21) Appl. No.: 14/365,469

(22) PCT Filed: Dec. 15, 2011

(86) PCT No.: PCT/CA2011/050776

§ 371 (c)(1), (2), (4) Date: Oct. 7, 2014

(87) PCT Pub. No.: WO2013/086605

PCT Pub. Date: Jun. 20, 2013

(65) Prior Publication Data

US 2015/0020458 A1 Jan. 22, 2015

(51) Int. Cl.
*E02D 29/14* (2006.01)

(52) U.S. Cl.
CPC ..... *E02D 29/1427* (2013.01); *E02D 29/14* (2013.01); *E02D 29/149* (2013.01)

(58) Field of Classification Search
CPC .... E02D 29/1427; E02D 29/149; E02D 29/14
USPC ..... 404/25, 26; 52/20; 49/463, 465, 466
See application file for complete search history.

(56) References Cited

U.S. PATENT DOCUMENTS

| | | | | | |
|---|---|---|---|---|---|
| 911,256 | A | * | 2/1909 | McWane | 220/251 |
| 1,384,712 | A | * | 7/1921 | Shanley | 404/25 |
| 3,858,998 | A | * | 1/1975 | Larsson et al. | 404/26 |
| 3,973,856 | A | * | 8/1976 | Gaglioti | 404/25 |
| 4,592,674 | A | * | 6/1986 | Baliva | 404/25 |
| 4,763,449 | A | * | 8/1988 | Vigneron et al. | 52/20 |
| 4,934,715 | A | | 6/1990 | Johnson | |
| 5,150,984 | A | * | 9/1992 | Bowman et al. | 404/26 |
| 5,240,346 | A | * | 8/1993 | Yin | 404/25 |
| 5,513,926 | A | * | 5/1996 | Prescott | 404/26 |
| 5,564,855 | A | * | 10/1996 | Anderson | 404/26 |
| 5,697,729 | A | * | 12/1997 | Bowman | 404/25 |

(Continued)

FOREIGN PATENT DOCUMENTS

| | | |
|---|---|---|
| DE | 19506436 | 9/1996 |
| GB | 509637 | 7/1939 |
| GB | 1482589 | 8/1977 |
| KR | 20040099508 | 12/2004 |
| KR | 100981680 | 9/2010 |

*Primary Examiner* — Katherine Mitchell
*Assistant Examiner* — Justin Rephann
(74) *Attorney, Agent, or Firm* — Norton Rose Fulbright Canada LLP

(57) ABSTRACT

A water inflow impervious manhole cover assembly includes a molded non-metallic frame, an imperforate manhole cover and a fastening mechanism releasably interconnecting the frame and the cover. The frame includes an annular peripheral frame wall defining a cover-receiving seat with a radially inwardly extending lip having a seating surface with an annular sealing channel formed therein. The fastening mechanism includes cams rotatable relative to the frame between a locked position wherein the cams engage the frame and an unlocked position wherein the cams are disengaged from the frame for removal of the cover. An annular watertight seal is formed between a bottom planar surface of the cover and the seating surface of the frame and a gasket retained within the annular sealing channel, when the cams of the fastening mechanism are disposed in the locked position.

19 Claims, 5 Drawing Sheets

(56) References Cited

U.S. PATENT DOCUMENTS

| | | | | | |
|---|---|---|---|---|---|
| 5,950,368 | A * | 9/1999 | Bradford | 52/20 |
| 5,956,905 | A * | 9/1999 | Wiedrich | 52/20 |
| 5,974,741 | A * | 11/1999 | Fukuhara | 52/20 |
| 6,007,270 | A * | 12/1999 | Bowman | 404/25 |
| 6,161,984 | A * | 12/2000 | Sinclair | 404/25 |
| 6,196,760 | B1 * | 3/2001 | Sinclair | 404/26 |
| 6,371,687 | B1 * | 4/2002 | Heintz et al. | 404/26 |
| 6,457,901 | B1 * | 10/2002 | Sondrup | 404/26 |
| 6,524,026 | B2 * | 2/2003 | Sondrup | 404/26 |
| 6,691,468 | B2 * | 2/2004 | Helferty | 49/463 |
| 6,953,302 | B1 * | 10/2005 | Kochling | 404/26 |
| 7,451,570 | B1 * | 11/2008 | Gavin | 52/20 |
| 7,726,903 | B2 * | 6/2010 | Vrondran et al. | 404/25 |
| 8,382,392 | B2 * | 2/2013 | Liao | 404/26 |
| 2002/0136605 | A1 * | 9/2002 | Sondrup | 404/26 |
| 2004/0013466 | A1 * | 1/2004 | Sondrup | 404/26 |
| 2005/0058505 | A1 * | 3/2005 | Nadasde | 404/26 |
| 2005/0241349 | A1 * | 11/2005 | Monneret et al. | 70/169 |
| 2008/0029973 | A1 * | 2/2008 | Knapp | 277/650 |
| 2009/0180832 | A1 * | 7/2009 | Vrondran et al. | 404/25 |
| 2009/0255183 | A1 * | 10/2009 | Nolle et al. | 49/57 |
| 2010/0028077 | A1 * | 2/2010 | Stadler | 404/25 |
| 2011/0222963 | A1 * | 9/2011 | Kelley et al. | 404/25 |
| 2013/0212945 | A1 * | 8/2013 | Lanham et al. | 49/25 |
| 2014/0109486 | A1 * | 4/2014 | Nolle et al. | 49/503 |

* cited by examiner

MANHOLE COVER ASSEMBLY WITH CAMS

TECHNICAL FIELD

The present invention relates generally to a manhole cover assembly and more particularly a manhole or catch basin assembly comprising separable component parts, such as a frame, adjustment riser(s) and a cover, which assemble to form a unitary structure.

BACKGROUND

Manhole openings are used to provide access to most underground facilities such as sanitary sewers and storm drains, utility conduits, etc. Such manhole openings, often located in the street or roadway, are covered by a manhole cover which is supported by a frame, typically made of metal, that is mounted on top of a concrete conduit or concrete riser. Thus, access to sewers or utility components is possible when the cover is removed from the support frame assembly, thereby allowing access to the lower structure and a subterranean conduit network interconnecting such concrete risers.

In known multi-component manhole assemblies, an adjustment riser is often disposed between the lower structure, for example the concrete riser, and the frame assembly within which the cover is supported. These adjustment risers have two functions, first they occupy the gap between the lower structure and the frame assembly to complete the assembly of the manhole or catch basin hole, and secondly they absorb mechanical vibrations developed above the frame assembly, such as by vehicles travelling over the metal cover when the hole is located in a road, and inhibit transmission of the mechanical vibrations to the lower structure. However, in circumstances when there is an angle or camber in the roadway and there is thus a need to be able install the manhole frame, and thus the cover, at a particular angle relative to the fixed concrete risers, existing risers have not proved sufficient to adequately control and modify an installation angle of the manhole cover as may be required. The use of known adjustment risers between the concrete base structure and the manhole frame, while advantageous for vibration damping, can make angular adjustment of the frame and cover, relative to the underlying concrete riser, difficult.

The covers of such known multi-component manhole assemblies typically have holes therethrough or do not seal well within their supporting frame, and therefore permit water ingress into the manhole. Therefore, known systems often include an inflow insert or catch basin which is provided beneath the manhole cover for the purposes of catching and collecting water inflow. Such catch basins need to be emptied on a fairly regular basis, which is clearly undesirable.

Additionally, the component parts of known manhole or catch basin assemblies are typically manufactured at poor manufacturing precision, such that a cover or closure member in which is the uppermost component is located generally flush with an exposed paved surface such as a road surface, fits poorly in the manhole or catch basin assembly and thus many gaps exist through which water ingress is possible. The other components of the assembly also tend to poorly fit and have gaps which provide a path for flow of water throughout the assembly structure.

As noted above, water inflow inserts provided beneath the cover of existing manhole assemblies for the purposes of collecting and/or redirecting rainwater, have been found to be insufficient for installations wherein a watertight access cover may be required. For example, subterranean vaults for electronics and/or telecommunications equipment, etc, need to be adequately sealed form the elements while still permitting access thereto via a manhole cover. It would be desirable to be able to prevent water from being able to flow through such manhole openings in order as to prevent any water ingress into such sensitive subterranean conduits and vaults.

SUMMARY OF THE INVENTION

It is an object to provide an improved manhole cover assembly.

In accordance with one aspect of the present invention, there is provided a water inflow impervious manhole cover assembly comprising: a molded non-metallic frame comprising an annular peripheral frame wall having an upper end defining an access opening therethrough and a lower face upon which the frame sits, the upper end of the peripheral frame wall defining a cover-receiving seat therein, the seat including a radially inwardly extending lip circumscribing said access opening and having a seating surface with an annular sealing channel formed therein, the sealing channel receiving a gasket therein; an imperforate manhole cover received within the seat of the frame member and having a bottom planar surface which abuts the seating surface of the lip and covers the annular sealing channel; and a fastening mechanism releasably interconnecting the manhole cover to the frame, the fastening mechanism including a number of cams rotatable relative to the frame between a locked position wherein the cams are matingly received within cam cavities formed in the peripheral frame wall such as to fasten the manhole cover to the frame, and an unlocked position wherein the cams are disengaged from the frame such as to permit removal of the manhole cover from the frame to expose said access opening; and wherein an annular watertight seal is formed, between the bottom planar surface of the manhole cover and the seating surface of the frame having said gasket retained within the annular sealing channel, when the cams of the fastening mechanism are disposed in the locked position.

There is further provided, in accordance with another aspect of the present invention, a water inflow impervious manhole cover assembly comprising: a molded non-metallic frame comprising a cover-receiving seat therein, the seat including a radially inwardly extending lip circumscribing an access opening and having an annular seal therein; an imperforate manhole cover received within the cover-receiving seat of the frame and having a bottom planar surface which abuts the radially inwardly extending lip and annular seal therein; and a fastening mechanism releasably interconnecting the manhole cover to the frame, the fastening mechanism including a number of cams rotatable relative to the frame between a locked position wherein the cams are matingly received within cam cavities formed in the frame such as to fasten the manhole cover to the frame, and an unlocked position wherein the cams are disengaged from the frame such as to permit removal of the manhole cover from the frame to expose said access opening.

DETAILED DESCRIPTION

Figure 1:
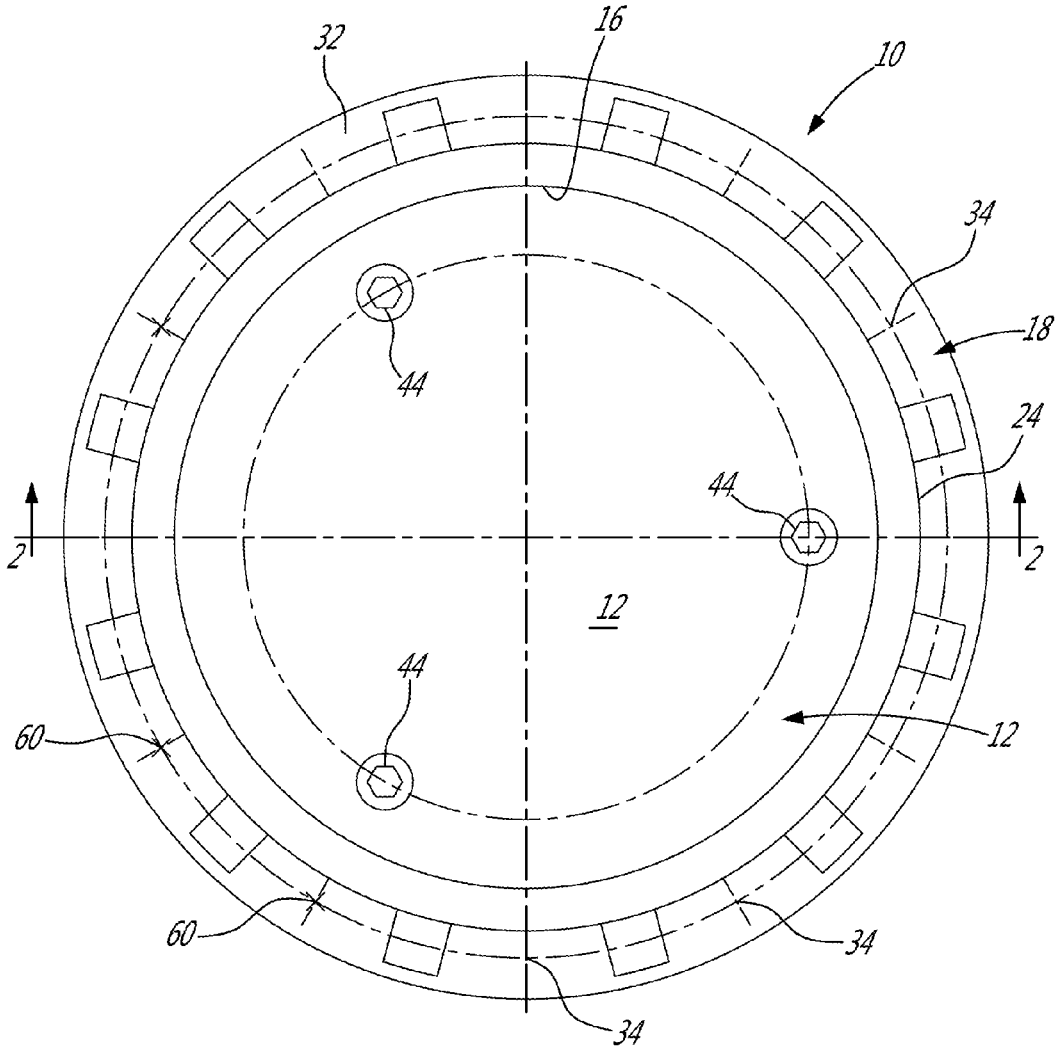
FIG. 1 is a top plan view of a manhole cover assembly in accordance with the present invention.
Figure 2:
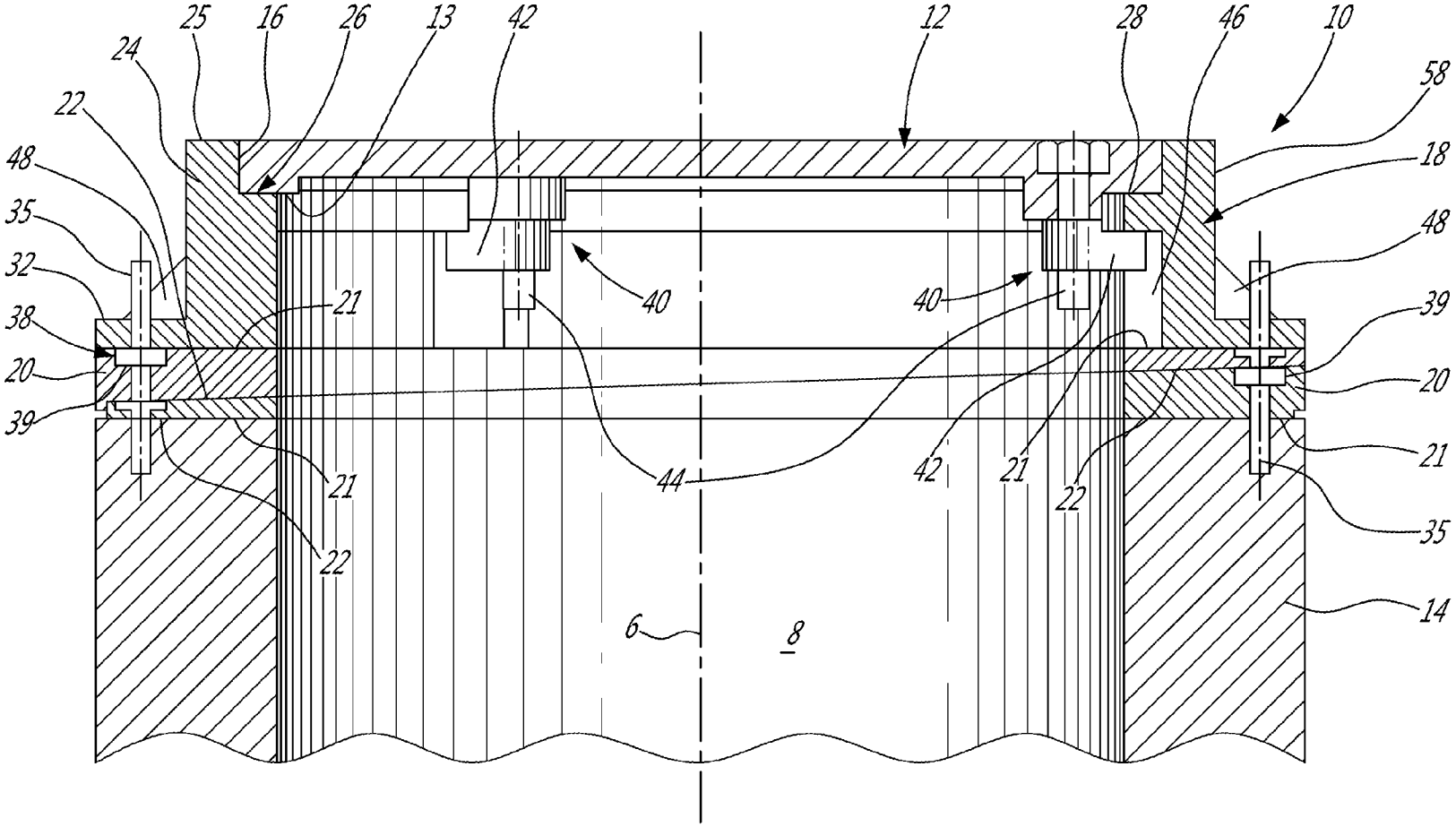
FIG. 2 is a cross-sectional view of the manhole cover assembly in accordance with the present invention, taken though line 2-2 of FIG. 1.

Referring to FIGS. 1 and 2, the water inflow impervious manhole cover assembly 10 of the present disclosure includes a molded non-metallic frame 18, formed of a structural rubber or a composite material for example, which is adapted to be installed upon and fastened to a vertically extending concrete conduit or riser 14 (see FIG. 2). An imperforate manhole cover 12 is received within and releasably interconnected to the frame 18, as will be described below, in order to seal the assembly 10 such that it is substantially water tight. The manhole cover assembly 10 as described herein is thus substantially impervious to water inflow, and therefore is particularly suited for installations wherein a watertight access cover may be required, such as for covering subterranean vaults containing electronics and/or telecommunications equipment for example.

The present manhole cover assembly 10 is an improvement upon previous manhole cover designs, such as those described in U.S. Pat. No. 6,1161,984 issued Dec. 19, 2000 and in U.S. Pat. No. 6,196,760 issued Mar. 6, 2001, the entire content of each of which is incorporated herein by reference.

The frame 18 of the present manhole cover assembly 10 includes an annual peripheral frame wall 24 having an upper end 25 which circumscribes the access opening defining the manhole passage 8 therethrough. The upper end 25 of the peripheral frame wall 24 also includes, as seen in further detail in FIGS. 4 and 5, a cover-receiving seat 26 therein which includes a radially inwardly extending lip 27 circumscribing said access opening 8 and defining a seating surface 28 upon which the cover 12 abuts.

This seating surface 28 has an annular seal 29 formed therein, which is formed by an annular sealing channel 30 defined in the seating surface 28 within which is disposed a gasket 31 or other elastomeric sealing member. The channel 30 has a frusto-conically shaped cross-section, whereby frusto-conical side walls 33 such as to define a wider channel base with a greater radial width and a narrower open channel top having a smaller radial width. This frusto-conically shaped annular sealing channel 30 allows for improved sealing, as when the circular gasket 31 is compressed by the manhole cover 12, it is forced to deform and fill the frusto-conically shaped cannel cavity 30, which ensures a water tight seal is forced between the cover 12 and the frame 18. The gasket 31 may be a pre-formed and one-piece gasket which is inserted into the channel 30 or may be a mastic or other sealant injected directly into the channel.

The annular seal 29 formed by the channel 30 and the sealing gasket therein, which as will be described further below, thereby forms an annular seal with a bottom planar surface 13 of the cover 12 when the cover is received within the seat 26 of the frame 18.

The peripheral frame wall 24 of the frame 18 includes a radially outwardly extending rim 32, beneath which is a lower face of the frame, in the form of a substantially flat planar surface 21, upon which the frame 18 sits. The rim 32 includes a plurality of fastening points 34 thereon disposed at circumferentially spaced apart locations on said radially outwardly extending rim 32, as seen in FIG. 1. These fastening points 34 may be radially aligned with an annular seal 38 formed between the planar surface 21 beneath the rim 32 of the frame 18 and the adjustment risers 20 disposed beneath the frame 18. Although such an annular seal 38 could be formed in either the lower surface of the frame's rim 32 or in the upper surface of the uppermost adjustment riser 20, as will be seen in further detail below with reference to FIGS. 2 and 6, in at least the presently preferred embodiment this annular seal 38 is created by a channel formed in the upper surface of the adjustment riser 20. Accordingly, any fasteners 35, such as bolts, etc., which are introduced down through the rim 32 of the frame 18 at the fastening points 34 in order to secure the entire assembly 10 to the concrete riser 14, intersect the annular seal 38 formed between the frame 18 and the cover adjustment risers 20. Because the fasteners 35 intersect the annular seal 38, the risk of water ingress into the assembly is further reduced.

In one embodiment, and as best seen in FIG. 1, the fastening points 34 may be identified by fastening indicia 60 disposed on the peripheral frame wall 24, and more particularly on the radially extending rim 32, which visually indicate a circumferential and radial location of each of the fastening points 34. As such, the installer of the present assembly simply needs to drill and/or otherwise form a hole through the rim 32 at the fastening points 34 as indicated by the indicia 60 located on the upper surface of the rim 32, such as to enable the fastening bolt used to fasten the frame to the supporting substrate to be inserted through the hole thus made at each of the fastening points 34 marked by the indicia 60.

The manhole cover 12 is imperforate (i.e. free of any through holes or apertures, etc.) and removably fastened in place within the opening 16 of the frame 18 in a sealed manner by a fastening mechanism 40, described in further detail below, such that water ingress into the manhole passage 8 is prevented.

As seen in FIG. 2, in one particular embodiment of the manhole cover assembly 10 at least two adjustment risers 20 are provided between the frame 18 and the concrete conduit or riser 14 upon which the manhole cover assembly 10 rests. The adjustment risers 20 each comprise a transversely tapered ring having a flat planar surface 21 on one side and an angled surface 22 on the opposed side. The angled surfaces 22 of each of the annular adjustment risers 20 face and abut each other such as to define an inclined mating plane therebetween. The annular adjustment risers 20 may be rotated relative to each other about a central and concentric axis 6, prior to installation of the frame 18 on top, such that the annular adjustment risers 20 slide in the inclined mating plane while remaining superimposed and concentric with each other. Accordingly, the relative vertical thickness of the combined adjustment risers 20 can be varied about their circumference, such as to form a larger spacing between the base of the frame 18 and the concrete riser 14 on one radial side thereof and a smaller spacing therebetween on the opposed radial side thereof. By so doing, the frame 18 of the manhole cover assembly 10 can be positioned at an angle relative to the central axis 6, and this angle can be adjusted by rotating the adjustment risers 20 relative to each other to increase or decrease the vertical thickness of the combined risers at a given circumferential position thereof. Although two risers 20 are shown in FIG. 2, it is to be understood that more of these angled risers 20 can be provided as needed.

The adjustment risers may have an interlocking tongue and groove connection therebetween, such as to permit lateral alignment and interconnection while nevertheless permitting relative circumferentially rotation relative to each other. This interlocking tongue and groove connection may be disposed at a radially outermost point of the rings forming the adjustment risers. The uppermost one of the rings 20 may also have a similar tongue and groove connection with the lower face of the peripheral frame wall 24 on the rim portion 32 of the frame 18, in order to laterally retain the adjustment risers and the frame together.

Figure 6:
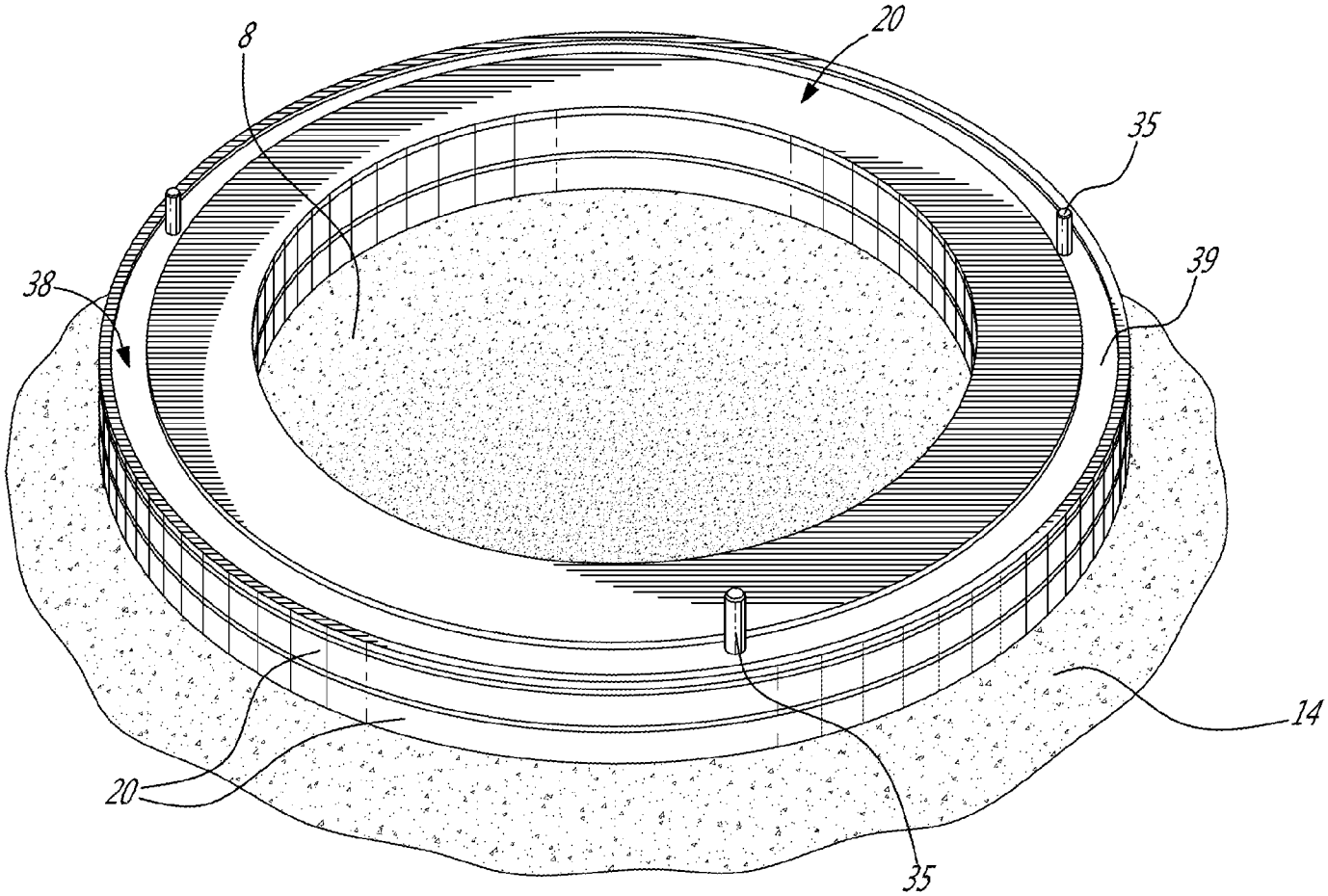
FIG. 6 is a perspective view of adjustment risers of the manhole cover assembly installed on a concrete riser.

As described briefly above and seen in FIG. 2 and FIG. 6, each of the adjustment risers 20 preferably has an annular channel 39 in at least one of the top and bottom surfaces 21 and 22 thereof, however in the depicted embodiment the annular channels 39 are formed in the top surface 21 of teach of the risers 20. The annular channel 39 receives a butyl mastic or other sealant therein such as to form the annular seal 38 between each of the adjustment risers 20, and also between the uppermost adjustment riser and the rim 32 of the frame 18. The annular seal forming channel 39 is located in radial alignment with the fastening points 34 and indicia 60 on the rim 32 of the frame 18 (see FIG. 2), and therefore in radial alignment with the bolts 35 extending through the frame and the adjustment risers 20 as seen in FIG. 6. Accordingly, the bolts 35 go directly through the butyl mastic or other sealant (not shown in FIG. 6) within the channel 39 in the upper surface of each adjustment riser 20, which improves the water-tightness of the annular seal 38 between the risers and also ensures a good seal around the bolt and their holes. This ensures the bolt holes through the risers and frame rim are tightly sealed and are not potential water entry points.

Although in the depicted embodiment the fasteners are radially aligned with the annular seal 38 formed between each of the adjustment risers 20, it is however also possible to form an alternate annular seal between each of the adjustment risers. For example, rather than using the aforementioned annular channel 39 within which a mastic or other sealant is disposed, the risers may have sealingly engaging tongue and groove connections therebetween and/or may have a "gasket" style sealing configuration (i.e. an elastic O-ring or other gasket material is inserted into the annular channels 39 formed in the adjustment risers), similar to that of the annular seal 29 between the cover 12 and the seating surface 28 of the frame, as described above and shown in FIGS. 4-5. In this alternate embodiment wherein a gasket seal is used, the fasteners 35 would not extend through the gasket or the sealing channel 39, given that the annular seal in this configuration is a non-mastic option and to do so would damage the gasket. This alternate gasket style sealing configuration also permits the adjustment risers to be made of a composite material, rather than being formed of a rubber material for example.

Referring still to FIG. 2, the fastening mechanism 40 which releasably interconnects the manhole cover 12 to the frame 18 includes a number of cams 42 which are rotatable relative to the frame about pins 44 which are mounted to the cover 12 and define rotation axes which are disposed, in at least the depicted embodiment, substantially perpendicularly to the bottom planar surface of the manhole cover 12. Three or more of these cams 42 may be provided as part of the fastening mechanism 40, which are preferably although not necessarily equally circumferentially spaced apart around the manhole cover at a radial point therein proximate the peripheral of the circular cover 12, as shown in FIG. 1 for example.

The cams 42 are thus rotatable relative to the frame between a locked position (as shown in FIG. 1), wherein the cams are matingly received within cam cavities 46 (see FIGS. 1 and 3) formed in the annual peripheral frame wall 24 and/or the rim 32 of the frame 18, and an unlocked position wherein the cams 42 are pivoted out of the cavities 46 and which are thus disengaged from the frame 18 such as to permit removal of the manhole cover 12 from the frame 18 to enable accessing to the opening 8. When the cams 42 are in the locked position, the manhole cover 12 is fastened in place to the frame 18 in a sealed manner, such as to prevent any water from being able to enter the subterranean cavity enclosed by the present assembly 10. Because the cams 42, when disposed in the locked position, force the bottom planar surface 13 of the cover 12 down vertically into forced abutting engagement with the seating surface 28 on the frame, thereby compressing the gasket 31 of the annular seal 29, a water tight seal is thereby formed.

Figure 3:
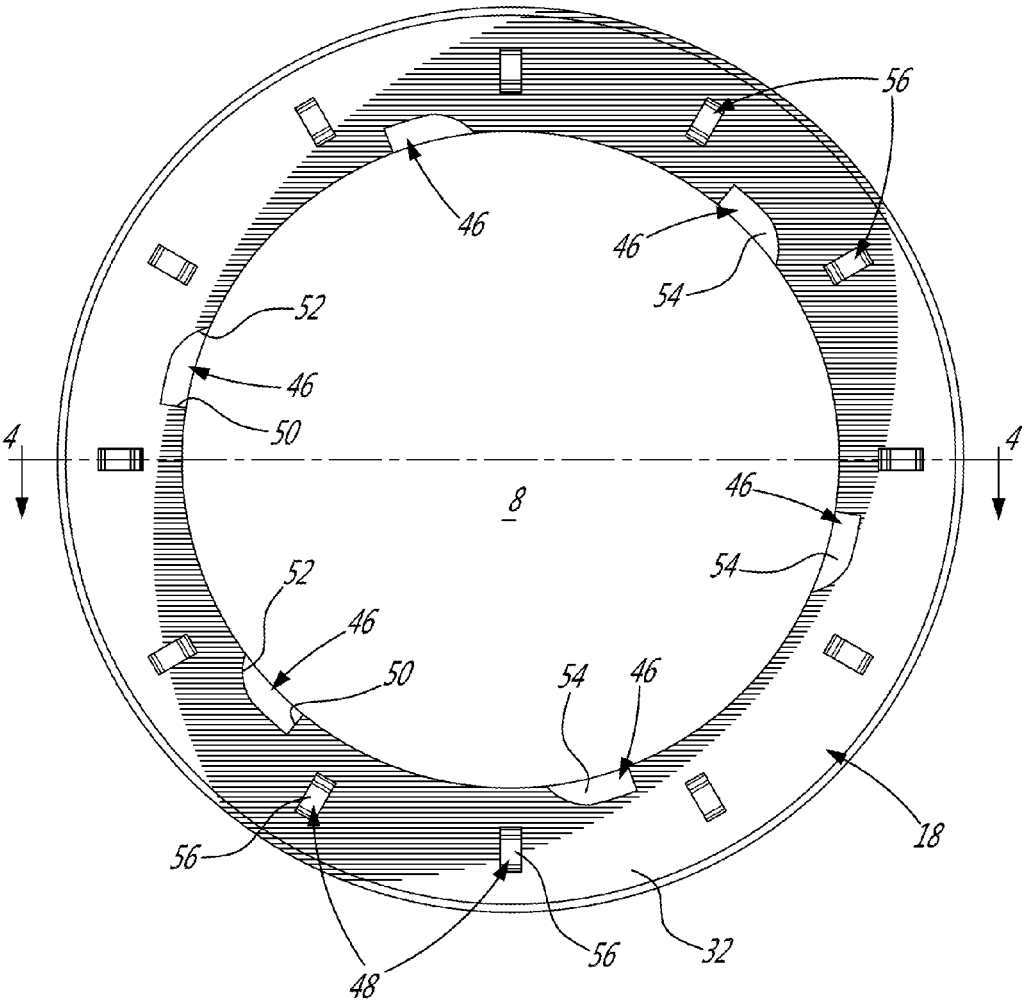
FIG. 3 is a bottom plan view of a frame of the manhole cover assembly of FIG. 2.

As seen in FIG. 3, the cam-receiving cavities 46 formed in the frame 18 include a flat radially extending wall 50 at one circumferential end of the cam cavity 46 and a curved wall 52 at an opposed circumferential end of the cam cavity. The curved wall 52 provides a progressive opening into the cam cavity 46 for receiving the cam 42 therein, and the flat radially extending wall 50 provides a stop against which the cam 42 abuts such as to prevent further rotation of the cam. This configuration of the cam cavity 46 enables a smoother locking movement of the cam, and a positive stop against which the cams abut in the fully locked position. The horizontal cam surface 54 within the cavities 46, against which the top face of the cams 42 abut when in the locked position, may be disposed at an incline, such that the fit with the cam 42 becomes tighter as the cam is rotated from the unlocked to the locked position thereof. Accordingly, the horizontal cam surfaces 54 may be inclined towards the circumferential ends of the cavities having the flat radially extending walls 50, such that the sealing fit formed when the cams are disposed in the fully locked position is the tightest.

Figure 4:
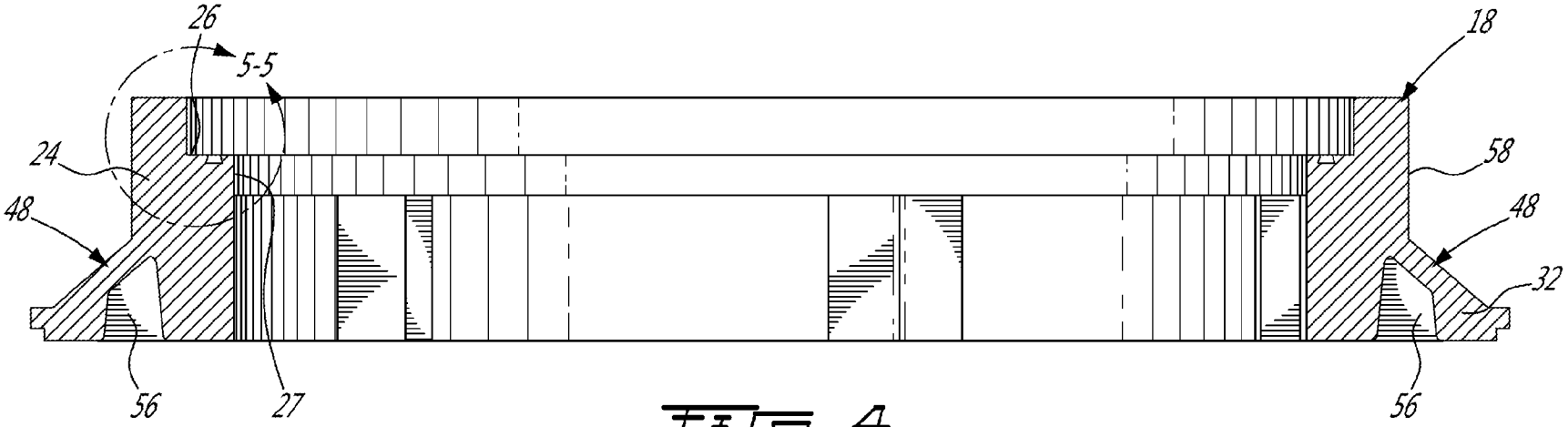
FIG. 4 is a cross-sectional view of the frame of the manhole cover assembly of FIG. 2, taken through line 3-3 of FIG. 3.
Figure 5:
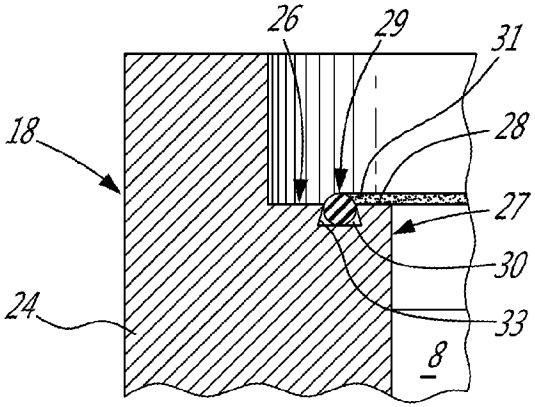
FIG. 5 is an enlarged, fragmentary, cross-sectional view of the frame of the manhole cover assembly, taken from region 5 in FIG. 4.

As seen in FIGS. 1 and 3, the frame 18 includes a plurality of gussets 48, which angularly extend between the peripheral frame wall 24 and the radially outwardly extending rim 32, which providing reinforcement and improve the overall structural integrity of the frame. The gussets 48 may be hollow, such that each defines a cavity 56 therein so as to reduce a thickness of the frame 18. Several advantages are achieved with this, including reducing a curing time of the moldable material during the molding of the frame, reducing the overall weight of the frame, reducing the cost of production, etc. In at least one embodiment, the peripheral frame wall 24 has a vertical height above the radially outwardly extending rim 32 that is greater than that of the gussets 48, as best seen in FIGS. 1 and 4, such as to define a gusset-free annular outer wall portion 58 on an upper external surface of the peripheral frame wall 24.

Although the components of the present water inflow impervious manhole cover assembly 10 may be made of any number of possible materials, which may be selected depending on the type of application and the anticipated usage. However, it at least one possible embodiment, the frame 18 is composed entirely one or more of a structural rubber and a composite material, and the manhole cover is composed of a non-metallic material such a composite. Alternately, however, the imperforate manhole cover may be formed from a material selected from the group consisting of: cast iron; ductile iron; fiber reinforced polyester (FRP); glass-fiber reinforced polyester (GRP); high-density Polyethylene (HDPE); and concrete.

It will be recognized that variations in the structure and composition as defined hereinbefore may be made without departing from the scope of the present invention as defined by the appended claims.

The invention claimed is:

1. A water inflow impervious manhole cover assembly comprising:

a molded non-metallic frame comprising an annular peripheral frame wall having an upper end defining an access opening therethrough and a lower face upon which the frame sits on a supporting substrate, the upper end of the peripheral frame wall defining a cover-receiving seat therein, the frame having a radially outwardly extendedly extending rim with fastening points disposed thereon at circumferentially spaced apart locations;

the seat including a radially inwardly extending lip circumscribing said access opening and having a seating surface with an annular sealing channel formed therein, the sealing channel receiving a gasket therein;

an imperforate manhole cover received within the seat of the frame member and having a bottom planar surface which abuts the seating surface of the lip and covers the annular sealing channel;

at least two adjustment risers disposed beneath the lower face of the peripheral frame wall for vertically spacing the frame away from the supporting substrate, and annular seal being disposed between at least two of the adjustment risers; and a fastening mechanism releasably interconnecting the manhole cover to the frame, the fastening mechanism including a number of cams rotatable relative to the frame between a locked position wherein the cams are matingly received within cam cavities formed in the peripheral frame wall such as to fasten the manhole cover to the frame, and an unlocked position wherein the cams are disengaged from the frame such as to permit removal of the manhole cover from the frame to expose said access opening, the fastening mechanism including fasteners for fastening the fram to the supporting substrate; and wherein an annular watertight seal is formed, between the bottom planar surface of the manhole cover and the seating surface of the frame having said gasket retained within the annular sealing channel, between the annular seal and the adjustment riser, and between the risers and the supporting substrate, when the cams of the fastening mechanism are disposed in the locked position, and when the fasteners extend axially through the rim of the frame at said fastening points radially aligned with the annular seal provided between the adjustment risers, through the adjustment risers, through the annular seal provided between the adjustment riser, and the into the supporting substrate.

2. The water inflow impervious manhole cover assembly as defined in claim 1, wherein the annular sealing channel defines a substantially frusto-conically shaped cross-section, the annular sealing channel having frusto-conical side walls such as to define a wider channel base with a greater radial width and a narrower open channel top having a smaller radial width.

3. The water inflow impervious manhole cover assembly as defined in claim 1, wherein each of the at least two adjustment risers comprises a transversely tapered ring having a flat surface on one side and an inclined surface on an opposed side, the inclined surfaces of each of the adjustment risers facing and abutting each other, the at least two adjustment risers being rotatable relative to each other about a common central axis such as to adjust an angular position of the frame relative to the supporting substrate.

4. The water inflow impervious manhole cover assembly as defined in claim 3, wherein the adjustment risers are retained together by an interlocking tongue and groove connection therebetween respectively formed in the inclined surfaces, the tongue and groove connection preventing relative lateral movement of the adjustment risers and the frame.

5. The water inflow impervious manhole cover assembly as defined in claim 4, wherein the interlocking tongue and groove connection between the adjustment risers is located at a radially outermost point of the transversely tapered rings.

6. The water inflow impervious manhole cover assembly as defined in claim 4, wherein an uppermost one of the adjustment risers is matingly engaged with the lower face of the peripheral frame wall by the tongue and groove connection to laterally retain the adjustment risers and the frame together.

7. The water inflow impervious manhole cover assembly as defined in claim 3, wherein the lower face of the frame wall includes a sealing assembly for sealingly engaging at least an uppermost one of the adjustment risers such as to prevent water ingress between the frame and the adjustment risers.

8. The water inflow impervious manhole cover assembly as defined in claim 7, wherein the sealing assembly includes at least one of an interlocking tongue and groove connection and an annular seal disposed between the lower face of the frame wall and the uppermost one of the adjustment risers.

9. The water inflow impervious manhole cover assembly as defined in claim 3, wherein the annular seal is disposed between each of the adjustment risers and between an uppermost adjustment riser and the frame, the annular seal preventing water ingress between the adjustment risers and between the frame and the uppermost adjustment riser, the annular seal comprising an annular channel formed therein within which is disposed a gasket.

10. The water inflow impervious manhole cover assembly as defined in claim 1, wherein the cams of said fastening mechanism are rotatably mounted to the manhole cover, the cams being rotatable about respective axes of rotation which are substantially perpendicular to the bottom planar surface of the manhole cover.

11. The water inflow impervious manhole cover assembly as defined in claim 10, wherein the fastening mechanism includes three or more of said cams equally circumferentially spaced apart around the manhole cover.

12. The water inflow impervious manhole cover assembly as defined in claim 1, wherein the frame is composed entirely of at least one of a structural rubber and a composite material.

13. The water inflow impervious manhole cover assembly as defined in claim 1, wherein the manhole cover is a composite material.

14. The water inflow impervious manhole cover assembly as define in claim 1, wherein the imperforate manhole cover is formed from a material selected from the group consisting of: cast iron; ductile iron; fiber reinforced polyester (FRP); glass-fiber reinforced polyester (GRP) high-density Polyethylene (HDPE); and concrete.

15. The water inflow impervious manhole cover assembly as defined in claim 1, wherein the annular seal provided between the adjustment risers includes an annular channel formed in an upper surface of each of the adjustment risers, the annular channel having a sealant therein and being radially aligned with said fastening points and therefore with said fasteners extending through the adjustment risers.

16. The water inflow impervious manhole cover assembly as defined in claim 1, wherein the fastening points are identified by fastening indicia disposed on the peripheral frame wall, the fastening indicia visually indicating a circumferential and radial location of each of the fastening points, such that a fastening bolt used to fasten the frame to the supporting substrate is insertable at each of said marked fastening points.

17. The water inflow impervious manhole cover assembly as defined in claim 1, wherein the frame includes a plurality of gussets angularly extending between the peripheral frame wall and a radially outwardly extending rim, the gussets being hollow and each defining a cavity therein so as to reduce a thickness of the frame member and thereby reduce a curing time of the moldable material during the molding of the frame and to reduce the overall weight of the frame.

18. The water inflow impervious manhole cover assembly of claim 17, wherein the peripheral frame wall has a height above the radially outwardly extending rim that is greater than that of the gussets, such as to define a gusset-free annular outer wall portion on an upper external surface of the peripheral frame wall.

19. The water inflow impervious manhole cover assembly of claim 1, wherein the cam cavities formed in the frame include a flat radially extending wall at one circumferential end of the cam cavity and a curved wall at an opposed circumferential end of the cam cavity, the curved wall providing a progressive opening into the cam cavity for receiving the cam therein and the flat radially extending wall providing a stop to prevent further rotation of the cam when the cam abuts against the flat radially extending wall.

* * * * *